US012607011B2

(12) United States Patent
De Frene et al.

(10) Patent No.: US 12,607,011 B2
(45) Date of Patent: Apr. 21, 2026

(54) FIXING DEVICE FOR MOUNTING WALL ELEMENTS FOR CONSTRUCTING A WALL

(71) Applicant: ARLU NV, Ardooie (BE)

(72) Inventors: Benjamin Joost De Frene, Waregem (BE); Michel Stefan Lefevre, Roeselare (BE); Lander Herreman, Kortrijk (BE); Alexander Pauwels, Kortrijk (BE); Tom Houthoofd, Roeselare-beveren (BE); Jean-Michel Philippe Jean-Paul Buess, Bruges (BE)

(73) Assignee: ARLU NV, Ardooie (BE)

( * ) Notice: Subject to any disclaimer, the term of this patent is extended or adjusted under 35 U.S.C. 154(b) by 234 days.

(21) Appl. No.: 18/263,509

(22) PCT Filed: Feb. 1, 2022

(86) PCT No.: PCT/IB2022/050844

§ 371 (c)(1),
(2) Date: Jul. 28, 2023

(87) PCT Pub. No.: WO2022/167920

PCT Pub. Date: Aug. 11, 2022

(65) Prior Publication Data

US 2024/0117630 A1 Apr. 11, 2024

(30) Foreign Application Priority Data

Feb. 2, 2021 (BE) ..... 2021/5075

(51) Int. Cl.
*E04B 2/96* (2006.01)
*E04B 2/78* (2006.01)
*E04B 2/02* (2006.01)

(52) U.S. Cl.
CPC ..... *E04B 2/7836* (2013.01); *E04B 2/967* (2013.01); *E04B 2002/0236* (2013.01)

(58) Field of Classification Search
CPC ..... E06B 3/68; E04B 2/7455; E04B 2/962; E04B 2/967; E04B 2/96; E04B 2/965;
(Continued)

(56) References Cited

U.S. PATENT DOCUMENTS 4,098,555 A * 7/1978 Vollenweider ..... E04B 2/967 403/20
5,155,952 A * 10/1992 Herwegh ..... E04B 1/6803 52/312

(Continued)

FOREIGN PATENT DOCUMENTS

DE 3048152 A1 6/1982
DE 3539003 C1 1/1987

OTHER PUBLICATIONS

International Search Report and Written Opinion for PCT/IB2022/050844, mailing date of May 25, 2022.

*Primary Examiner* — Jessica L Laux
(74) *Attorney, Agent, or Firm* — FRESH IP PLC; Terrence L.B. Brown; Clifford D. Hyra

(57) ABSTRACT

A fixing device for mounting wall elements for constructing a wall, includes: a support profile, A securing element which is designed to extend between the wall elements and can be twisted relative to the support profile between a first position in which an engagement element of the securing element remains separate from the support profile, and a second position in which the engagement element engages on the support profile for fixing and secures the wall elements; and a closing profile which in the second position is attachable to the securing element and comprises a blocking element for preventing the securing element from twisting back.

17 Claims, 9 Drawing Sheets

(58) Field of Classification Search
CPC ..... E04B 2/88; F16B 39/32; E04F 15/02005; E04F 15/14; E04F 15/145; E04F 21/0092
See application file for complete search history.

(56) References Cited

U.S. PATENT DOCUMENTS 5,481,839 A * 1/1996 Lang ..... E04B 2/967 52/489.1
6,016,632 A * 1/2000 McGee ..... E06B 3/9636 52/584.1
6,141,923 A * 11/2000 Habicht ..... E04B 2/967 52/235

* cited by examiner

FIXING DEVICE FOR MOUNTING WALL ELEMENTS FOR CONSTRUCTING A WALL

This application is a National Phase entry of International Application No. PCT/IB2022/050844 under § 371 and claims the benefit of Belgian Patent Application No. BE2021/5075, filed Feb. 2, 2021, each of which is hereby incorporated by reference in its entirety.

The invention concerns a fixing device for mounting wall elements for constructing a wall, said fixing device comprising:

- a support profile having a holding side for fixing the wall elements thereto;
- a securing element which is provided with an engagement element for engaging on the support profile for fixing the securing element to the support profile, and which is designed to extend between the wall elements; and
- a closing profile which is attachable to the securing element for holding the wall elements between the support profile and the closing profile.

Such a fixing device is suitable for mounting a plurality of wall elements but may also be used for mounting a single wall element.

Such fixing devices are typically used to divide larger rooms into smaller rooms, wherein for example meeting areas can be separated from office areas. The larger rooms are here divided by one or more wall elements such as glass panels and/or wooden panels etc. These fixing devices are not restricted to the construction of walls in interior spaces but are also used for erecting exterior walls. Such wall elements must be able to be erected quickly and flexibly and be removable again later.

Fixing devices for mounting wall elements between said support profiles and closing profiles are known for example from DE 1 079 290 B, DE 198 04 925 A1, EP 0 821 127 A2, AT 392 714 B, DE 41 07 743 A1, DE 196 51 365 A1, EP 0 652 335 A1, NL 1 016 724 C, DE 43 31 963 A1 U.S. Pat. No. 4,098,555 A and DE 30 48 152 A1.

The support profiles here must firstly be positioned precisely and securely. After positioning the support profiles, one or more wall elements are attached to the support profiles. Then various systems are known for fixing the closing profiles to support profiles. The wall elements must in each case be positioned and then firmly held either manually or by associated aids so as to be able to attach the closing profiles.

DE 1 079 290 B and DE 198 04 925 A1 disclose fixing devices in which the closing profiles are attached directly to the support profiles by a click connection. In EP 0 821 127 A2, the closing profiles and the support profiles are click-fastened to one another by means of an elastic profile. This is however not straightforward with heavy wall elements. In EP 0 652 335 A1, embodiments are described in which the wall elements are first click-fastened by means of securing elements and then the support profiles are attached. In DE 43 31 963 A1, the closing profiles are fixed to the support profiles with a barbed connection. Such clip connections and barbed connections are typically only suitable for mounting lighter wall elements and/or horizontally lying wall elements, e.g. in order to create a lighting strip. If these click connections or barbed connections are however made sufficiently stiff to be able to hold heavy wall elements, in practice it is not easy to implement such a connection.

AT 392 714 B, DE 41 07 743 A1, DE 196 51 365 A1, EP 0 652 335 A1 and NL 1 016 724 C describe and depict embodiments in which the wall elements are first screwed or bolted to the support profiles by means of securing elements so as to be able to hold the wall elements securely, whereafter the closing profiles are click-fastened to these securing elements. Mounting such fixing devices is relatively cumbersome.

U.S. Pat. No. 4,098,555 A describes a relatively complex fixing system in which a bolt is used comprising two coaxial parts which can be twisted relative to one another in order to be able to attach both ends of this bolt to corresponding profiles with respect to wall elements mounted in between.

DE 30 48 152 A1 describes a fixing device according to the introductory part of claim 1.

The object of the invention is to provide a fixing device by means of which such walls can be erected more easily but sufficiently securely, without the wall elements having to be held firmly in order to be able to attach the closing profiles.

This object of the invention is achieved by providing a fixing device for mounting wall elements for constructing a wall, said fixing device comprising:

- a support profile having a holding side for fixing the wall elements thereto;
- a securing element which is provided with an engagement element for engaging on the support profile for fixing the securing element to the support profile, and which is designed to extend between the wall elements; and
- a closing profile which is attachable to the securing element for holding the wall elements between the support profile and the closing profile;

wherein for fixing to the support profile, the securing element is twistable relative to the support profile between:

- a first position in which the engagement element remains separate from the support profile so that the securing element is movable transversely on the holding side relative to the support profile; and
- a second position
  - in which the engagement element engages on the support profile so as to fix the securing element to the support profile,
  - in which the closing profile is fixable to the securing element, and
  - in which the securing element is designed to secure the wall elements;

and wherein the closing profile comprises a blocking element in order, on fixing of the closing profile to the securing element, to prevent the securing element from twisting back from the second position to the first position.

The support profile from a fixing device according to this invention may be mounted in a known fashion, after which the wall elements can be attached to the support profile.

The securing element may be attached to the support profile particularly easily by twisting, and the wall elements are thus directly secured. Securing takes place much more easily than in the prior art, in which said securing element is screwed or bolted. The securing element for securing the wall elements may also be designed much more stiffly than the securing elements from the prior art, via which the wall elements are locked by means of a click connection, so that walls with heavier wall elements may also be erected in this way.

The wall elements can also be attached and released easily, in that they need no longer be counter-held by a second person and/or by aids in order then to attach the closing profile to the securing element.

The closing profile in addition provides a secondary securing which prevents the securing element from being able to detach from the support profile by twisting back.

The closing profile here can preferably be releasably fixed to the securing element, so that with this fixing device, walls can quickly and repeatedly be erected, dismantled again and re-erected if desired.

For securing the wall elements, the securing element preferably comprises a first securing edge for a first said wall element to engage behind in the second position, and a second securing edge for a said second wall element to engage behind in the second position. Each wall element mounted in this way is then held between the support profile and a corresponding securing edge of the securing element, so that it can safely be released before the closing profile is fixed.

In a specific embodiment, the support profile on the holding side comprises at least one undercut retention edge, and the securing element is provided with at least one said engagement element corresponding to the retention edge, for engaging behind the retention edge in order to fix the securing element to the support profile.

Alternatively or additionally, in the twist movement from the first position to the second position, a clamping connection can be achieved between the securing element and the support profile. The securing element may here for example engage by clamping on walls of a groove in the support profile or on walls of a protruding part of the support profile. More specifically, the securing element may engage by clamping on a said retention edge.

A said retention edge may for example be provided as a collar which partially delimits a groove in the support profile.

Preferably, the one or more said engagement elements of the securing element extend at an end of the securing element radially with respect to this securing element, and the support profile is provided with an attachment groove which is delimited on either side towards the holding side by a said undercut retention edge of this support profile.

Alternatively, the support profile may for example be provided with grooves which are open towards the lateral edges of the support profile, wherein the retention edges are configured as shoulders which shield these grooves towards the holding side.

The securing element and/or the support profile is preferably provided with a limiting element for limiting the rotational movement of the securing element on twisting of the securing element from the first position to the second position.

When the rotational movement is limited in this way, the fixing may be carried out particularly easily since this is automatically limited by the limiting element.

The securing element is preferably designed to be twistable over a specific angle in order to implement the connection with the support profile. This specific angle may in principle be freely selected. Preferably, this specific angle is 90°.

The closing profile is preferably fixable to the securing element by means of a click connection.

Such a click connection is a particularly simple connection for easily attaching the closing profile to the securing element, wherein this closing profile then may also be used as a finishing profile without visible fixing means such as e.g. screws.

More specifically, the closing profile may be provided with an attachment groove which is delimited on either side by an undercut retention edge. Here, the securing element may be provided with two click legs corresponding to the retention edges of the closing profile, for click-fastening the securing element behind the retention edges of the closing profile in order to implement the click connection.

The click legs of the securing element are here preferably connected together by an elastic connection. Over time, plastic in particular loses some strength in the material. A central elastic connection between the click legs will ensure a more stable click-fastening and greater stability of the click legs after the course of time.

Instead of attaching at least one click leg of the securing element in a groove of the closing profile, alternatively for example at least one click leg of the securing element may also engage on a protruding part of the closing profile in order to implement the click connection. Thus for example at least a part of the closing profile may engage in an opening in the securing element.

Instead of providing the securing element with one or more click legs, for example alternatively or additionally, the closing profile may be provided with one or more click legs which, for example, engage in an opening in the securing element or engage on a protruding part of the securing element.

When the closing profile is provided with an above-mentioned attachment groove, this attachment groove is preferably provided with upright side edges which each serve as a said blocking element.

In a specific embodiment, the securing element may comprise a support profile fixing part which is provided with said engagement element for fixing to the support profile, and comprise a closing profile fixing part which is provided for fixing to the closing profile, and comprise a core which connects together the support profile fixing part and the closing profile fixing part.

The closing profile fixing part is here preferably also provided for securing the wall elements. If the securing element comprises a said first securing edge and a said second securing edge, then these preferably form part of the closing profile fixing part. These upright edges preferably form part of flanges which protrude relative to the core. More specifically, these securing edges may form part of a securing face which protrudes radially relative to the core and may also form part of the closing profile fixing part.

The part of the securing element which in mounted state extends between the wall elements may be configured so as to be rigid. If walls are to be erected with wall elements of different thicknesses, securing elements with different corresponding dimensions should be provided.

In order to support such different thicknesses with the same securing elements, a fixing device according to this invention is preferably provided with adjustment means for setting the intermediate distance, viewed between the support profile and closing profile, when the securing element is attached to the support profile and when the closing profile is attached to the securing element.

More specifically, for this said core may be configured so as to be flexible, wherein the adjustment means are designed to move the support profile fixing part and the closing profile fixing part relative to one another by means of deformation of the core.

The support profile fixing part and the closing profile fixing part may here more specifically be moved towards and apart from one another e.g. by means of a screw. This screw is here not used for fixing the securing element but merely for adjusting said intermediate distance. This intermediate distance may here also be set in a state in which the securing element is separate from the support profile and from the closing profile before they are attached to one another.

Alternatively, the securing element may for example be provided with several said engagement elements which form part of the adjustment means and are designed for stepped engagement on the support profile for fixing the securing element to the support profile.

Furthermore, alternatively or additionally, said adjustment means may for example comprise a click-in element with several click edges, designed for stepped implementation of a click connection.

More specifically, the core may here for example comprise a first core part which is provided with said click-in element, and a second core part which is provided with an engagement edge for a said click edge of the click-in element to engage behind in order to implement the click connection to form the core.

When the core is thus constructed from several core parts, furthermore a screw may also be provided for additionally fixing these core parts to one another by means of said screw.

Alternatively, if the securing element is provided with several engagement elements, said engagement elements together, more specifically, may form said click-in element.

The securing element may furthermore also be provided with markings for setting different intermediate distances. The securing element may then in this way easily be set in advance to the correct intermediate distance before this securing element is fixed to the support profile in order to secure the wall elements.

The securing element is furthermore preferably configured so as to be rotationally symmetrical so that this securing element can easily be correctly positioned relative to the support profile.

The support profile and the closing profile are preferably identical to one another so that, on mounting, they may be interchanged.

The object of the invention is furthermore also achieved by providing a wall assembly comprising two wall elements and a fixing device for mounting said wall elements, wherein the fixing device is a fixing device according to the invention as described above.

The invention is now explained in more detail with reference to the following detailed description of some preferred embodiments of fixing devices and walls according to this invention. The aim of this description is exclusively to give clarifying examples and indicate further advantages and features of this invention, and therefore may not be interpreted as a restriction of the area of application of the invention or of the protected rights claimed in the claims.

In this detailed description, by means of reference signs, reference is made to the accompanying drawings in which.

Figure 1:
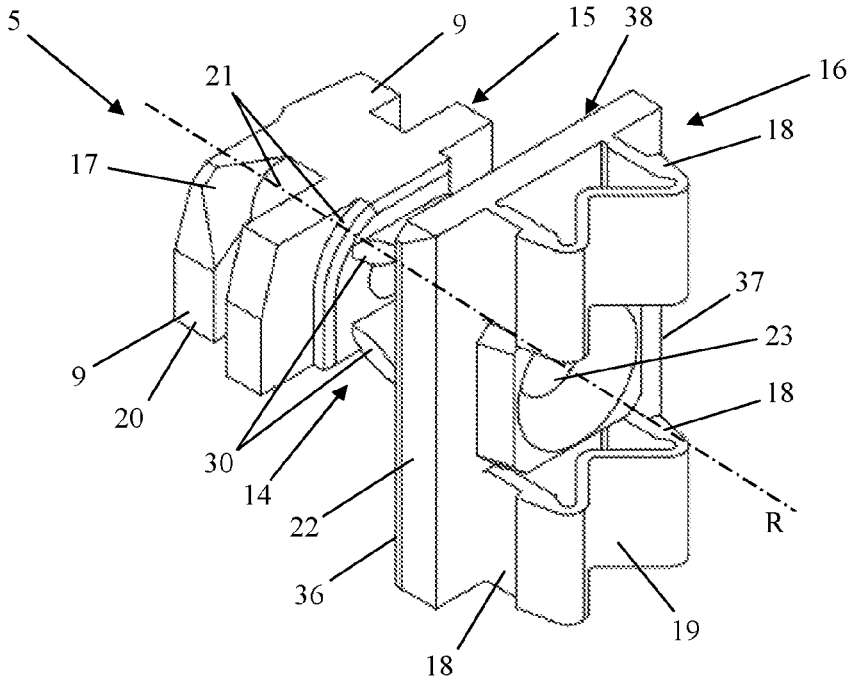
FIG. 1 shows in perspective a first embodiment of a securing element of a fixing device according to the invention, viewed from above, from the front, from the left side.
Figure 2:
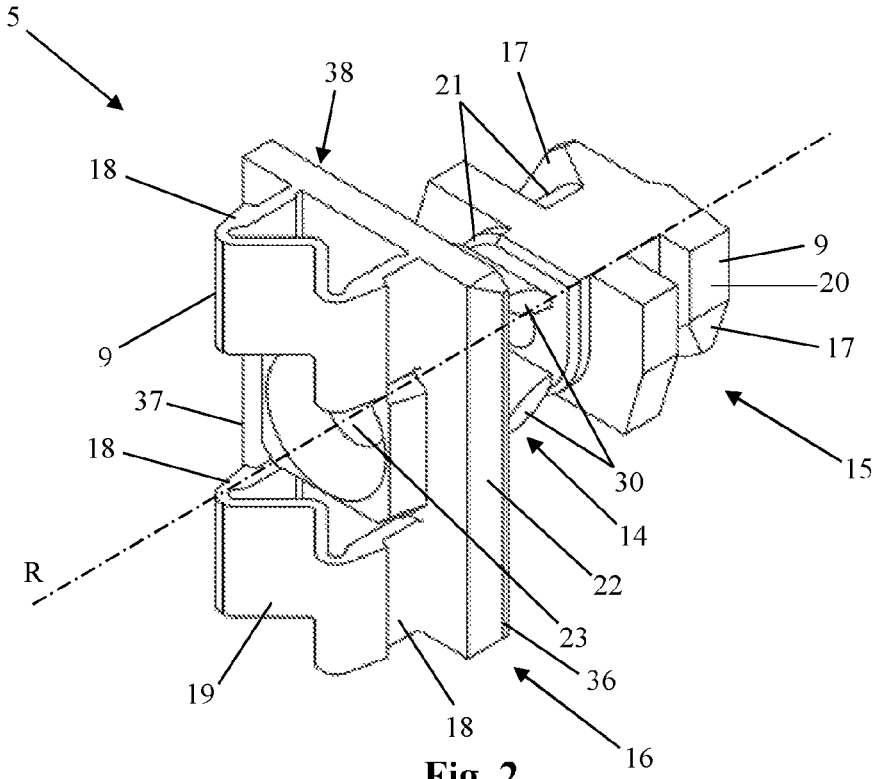
FIG. 2 shows in perspective the securing element from FIG. 1 viewed from above, from the front, from the right side.
Figure 3:
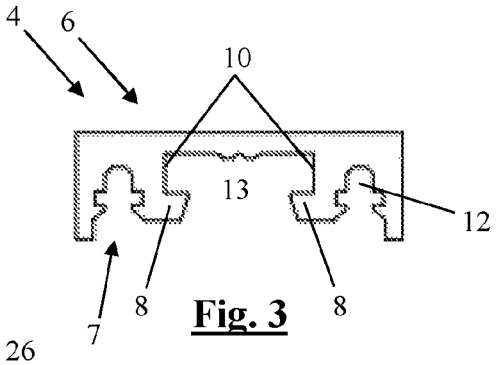
FIG. 3 shows in top view a first embodiment of a support profile of a fixing device according to the invention which also serves as a closing profile.
Figure 4:
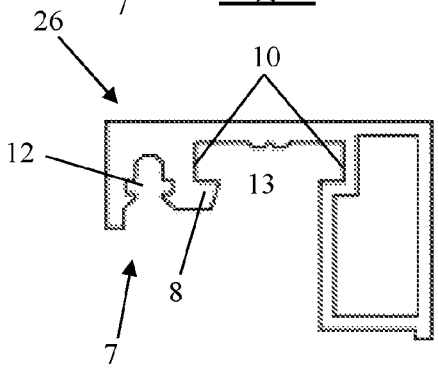
FIG. 4 shows in top view an end profile for a fixing device according to the invention.
Figure 5:
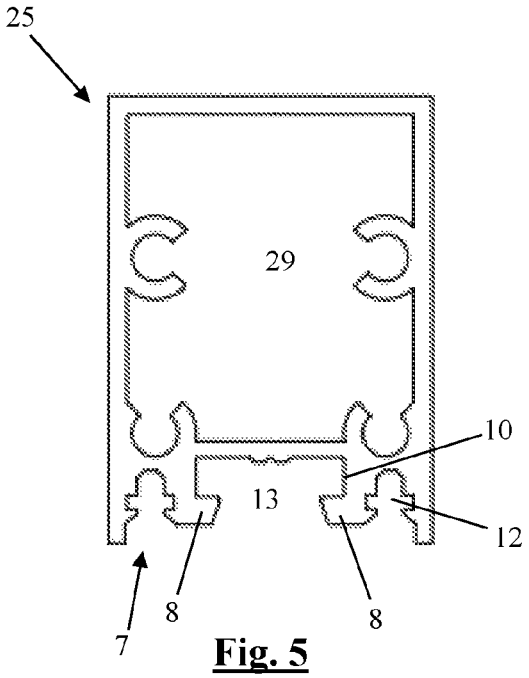
FIG. 5 shows in top view an alternative embodiment for a support profile of a fixing device according to the invention.
Figure 6:
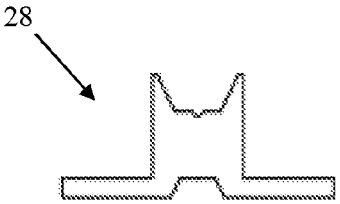
FIG. 6 shows in top view a standard profile of a fixing device according to the invention.
Figure 7:
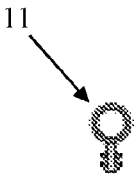
FIG. 7 shows in top view a seal of a fixing device according to the invention.
Figure 8:
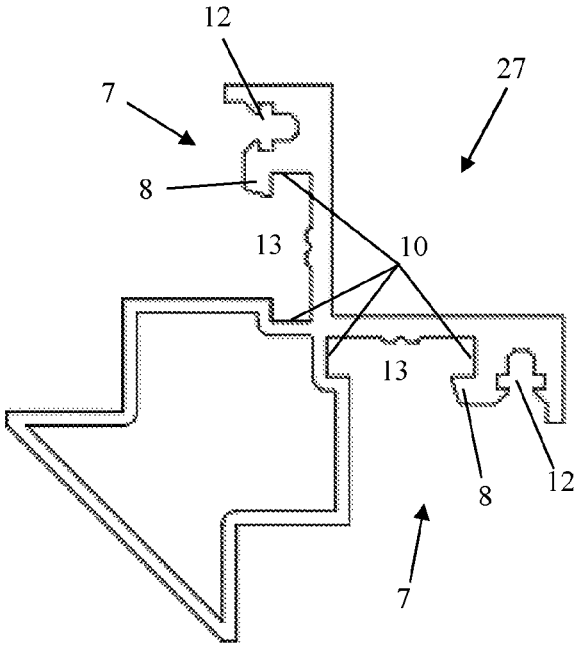
FIG. 8 shows in top view a corner profile of a fixing device according to the invention.

The wall assembly (1) shown comprises various panels (3) which are mounted by means of a fixing device (2) according to this invention in order to form walls.

These panels (3) may serve as partition walls and for this may assume many forms. They may be glass panels (3), wooden panels, plastic panels, acoustic panels etc.

The fixing device (2) illustrated comprises support profiles (4, 25, 26, 27) and closing profiles (6), between which the panels (3) may be fixed. The support profiles (4, 25, 26, 27) for this may be fixed in a room by means of standard profiles (28). For this, the closing profiles (6) are fixable to the support profiles (4, 25, 26, 27) by means of securing elements (5).

A first support profile (4), in the embodiment shown, is configured so as to be identical to the closing profile (6).

A second support profile (25) is designed thicker than the closing profile (6). This may for example serve to make the support profile (25) more rigid and/or use the cavity (29) thereof functionally and/or for aesthetic reasons.

A third support profile (26) is designed as an end profile (26) in order to be able to terminate and aesthetically finish a wall to be free-standing in a room.

A fourth support profile (27) is designed as a corner profile (27) in order to connect walls together at an angle relative to one another in an aesthetically pleasing fashion, With the corner profile (27) shown, walls can be connected together at an angle of 90°. Similarly, corner profiles (27) can also be designed to connect together walls at different angles, such as for example 45° or 135°.

The support profiles (4, 25, 26, 27) and closing profiles (6) shown may for example be produced by extrusion so that they can easily be cut to length without loss of functionality.

Each of the support profiles (4, 25, 26) and closing profiles (6) is provided with a holding side (7) for fixing the panels (3) to this.

The corner profile (27) is provided with two such holding sides (7) at 90° to each other so that panels (3) attached to this also extend at 90° relative to one another.

On their holding sides (7), the support profiles (4, 25, 26, 27) and closing profiles (6) are provided with grooves (12) for placing seals (11) therein which protrude relative to the holding sides (7) and are elastic so that they can be compressed when the panels (3) are attached to these holding sides (7).

Figure 27:
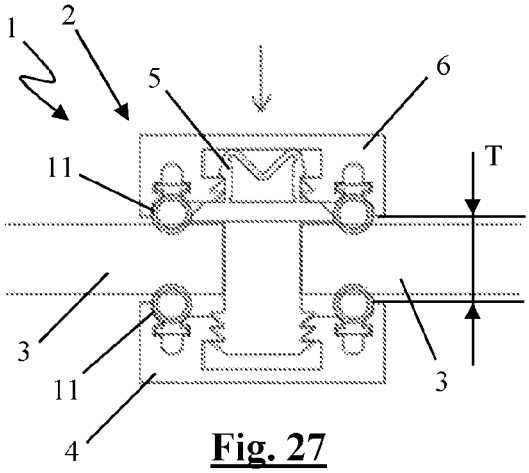
Figure 28:
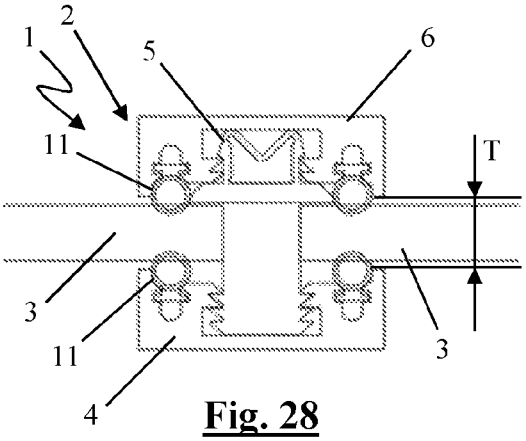
FIG. 28 shows in top view how two thinner glass panels can be fixed with the securing element from FIG. 20 between the support profile and the closing profile from FIGS. 24 to 27, in order to construct a wall.
Figure 29:
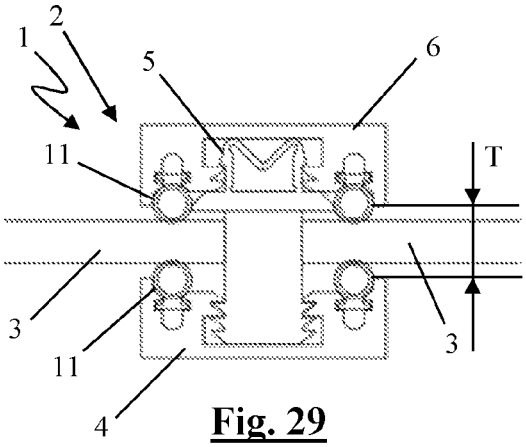
FIG. 29 shows in top view how two even thinner glass panels can be fixed with the securing element from FIG. 20 between the support profile and the closing profile from FIGS. 24 to 27, in order to construct a wall.
Figure 30:
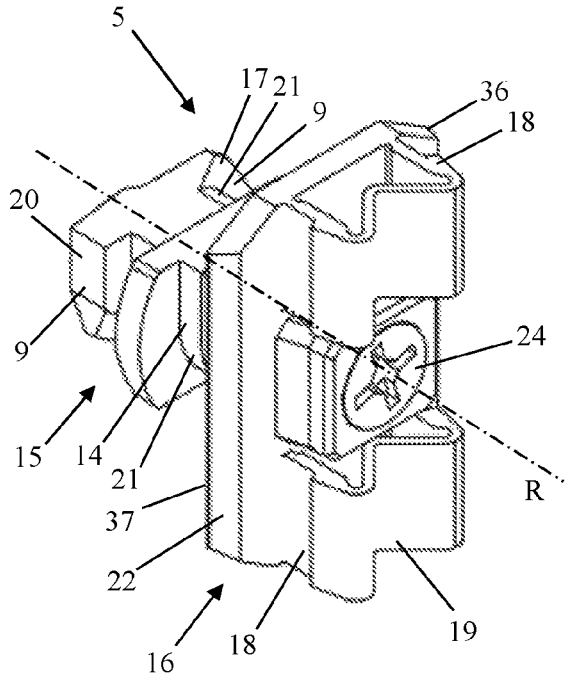
FIG. 30 shows in perspective a third embodiment of a securing element of a fixing device according to the invention, viewed from above, from the front, from the left side.
Figure 31:
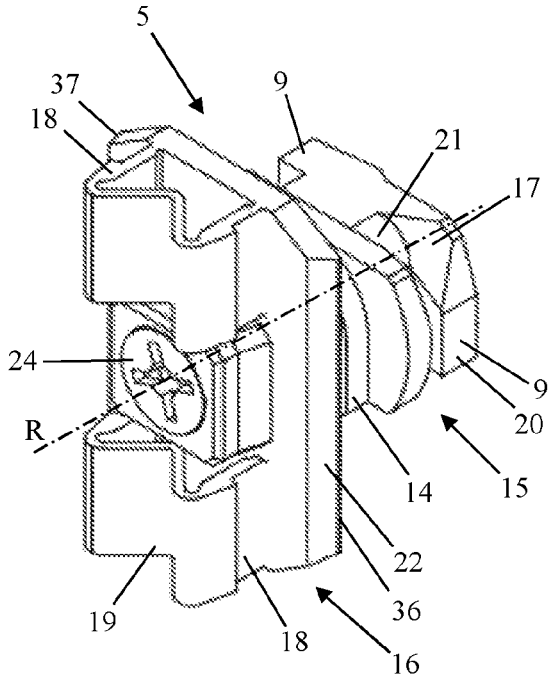
FIG. 31 shows in perspective the securing element from FIG. 30 viewed from above, from the front, from the right side.
Figure 32:
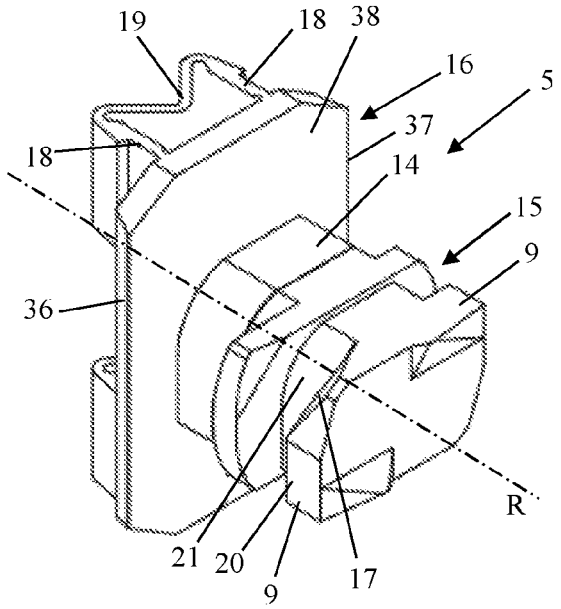
FIG. 32 shows in perspective the securing element from FIG. 30 viewed from above, from behind, from the left side.
Figure 33:
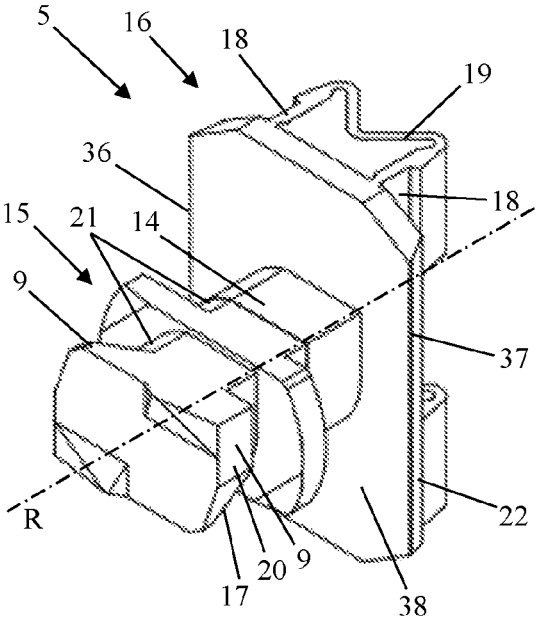
FIG. 33 shows in perspective the securing element from FIG. 30 viewed from above, from behind, from the right side.
Figure 34:
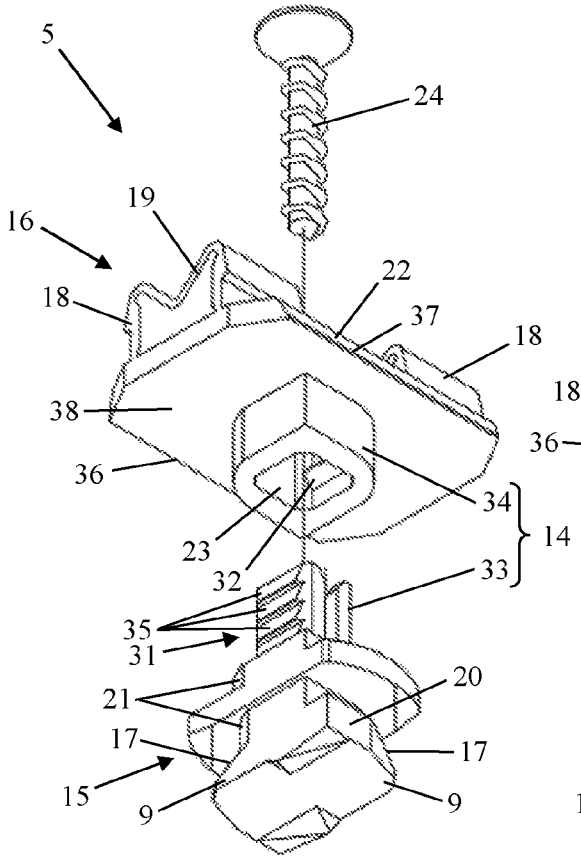
FIG. 34 shows in perspective the securing element from FIG. 30 in opened state, slightly twisted relative to FIG. 33.
Figure 35:
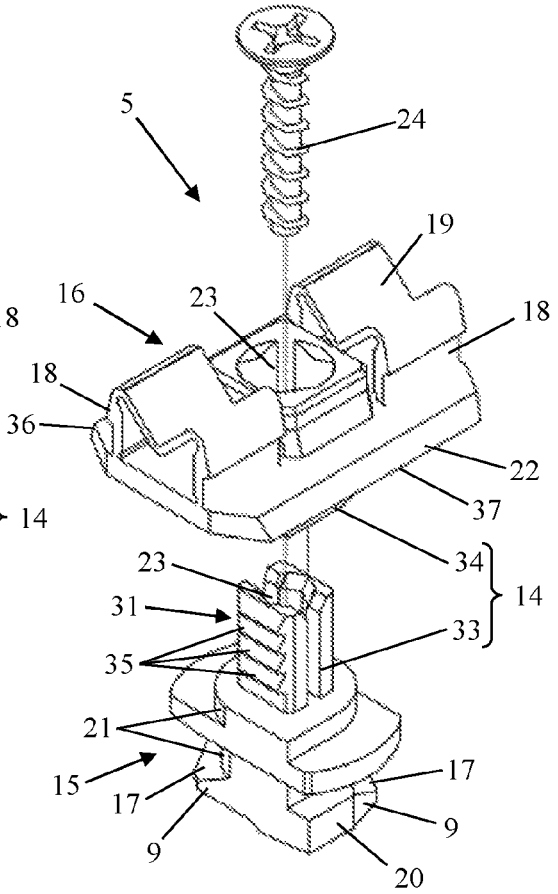
FIG. 35 shows in perspective the securing element from FIG. 30 in opened state, viewed from the opposite side from FIG. 34.
Figure 36:
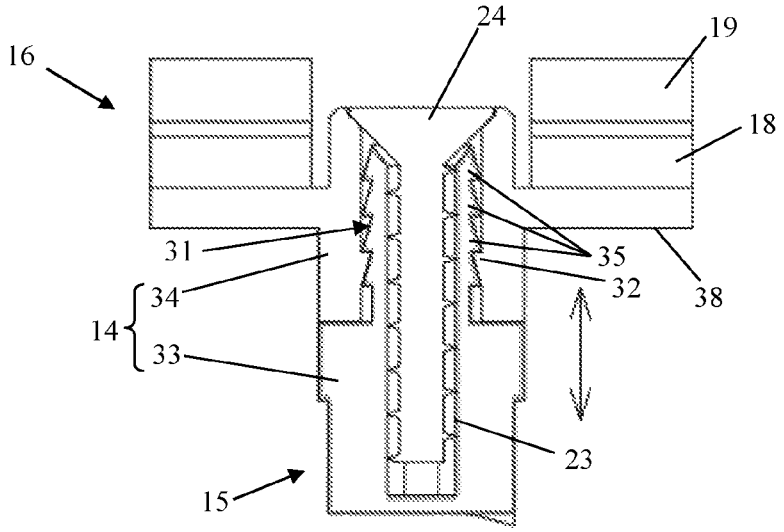
FIG. 36 shows a securing element from FIG. 30 in cross-section, cut through the screw inserted therein.

The support profiles (4, 25, 26, 27) and closing profiles (6) are furthermore provided on their holding sides (7) with an attachment groove (13) which is delimited on both sides by an undercut retention edge (8) which forms a collar relative to an upright side wall (10) of the attachment groove (13). In the embodiment shown in FIGS. 24 to 29, the support profile (4) is provided with an additional undercut retention edge (8) so that the securing element (5) can thereby be fixed adjustably to said support profile (4), as shown in FIGS. 27 to 29 and as will be discussed further below.

The securing elements (5) comprise firstly a support profile fixing part (15) for fixing to a support profile (4, 25, 26, 27) and secondly a closing profile fixing part (16) for fixing to a closing profile (6). A core (14) which connects together the support profile fixing part (15) and the closing profile fixing part (16) is designed to extend between the panels (3) in mounted state.

Each securing element (5) is designed to be fixed to a support profile (15) by twisting said securing element (5) around a virtual rotational axis (R) of this securing element (5).

For this, the support profile fixing part (15) of the securing element (5) is provided with an engagement edge (9) which, viewed relative to the rotational axis (R), extends radially relative to the securing element (5) for engagement behind the retention edge (8) of a support profile (4, 25, 26, 27) in order to fix the securing element (5) to the support profile (4, 25, 26, 27). In the embodiment shown in FIGS. 20 to 29, the securing element (5) is provided with several such engagement edges (9) so that the securing element (5) can thereby be fixed adjustably to said support profile (4), as shown in FIGS. 27 to 29 and as will be discussed further below.

Figure 9:
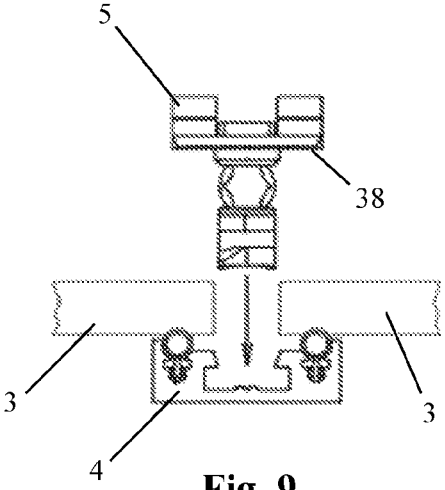
FIGS. 9 to 14 show, in various stages and in top view, how two glass panels may be fixed by means of the securing element from FIG. 1 between a support profile from FIG. 3 and a closing profile from FIG. 3 in order to construct a wall, wherein the securing element is shown in cross-section in FIG. 13 in order to illustrate the screw inserted through this.
Figure 10:
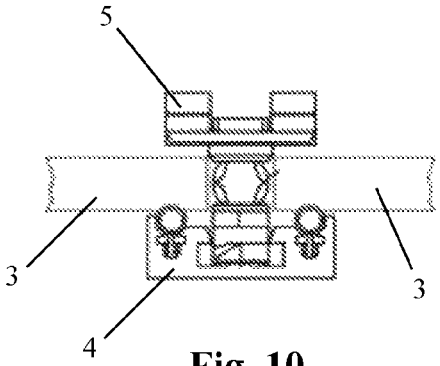
Figure 11:
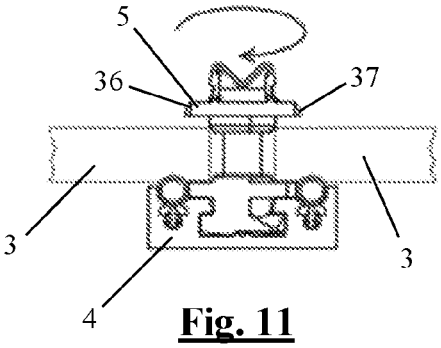
Figure 24:
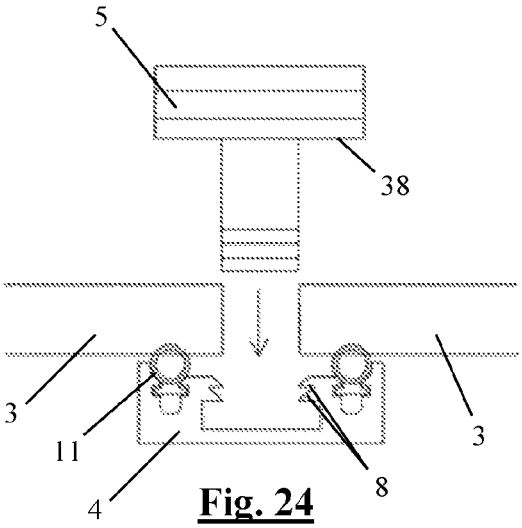
FIGS. 24 to 27 show in various stages, in top views, how two glass panels can be fixed by means of the securing element from FIG. 20 between an alternative embodiment of a support profile and an alternative embodiment of a closing profile, in order to construct a wall.
Figure 25:
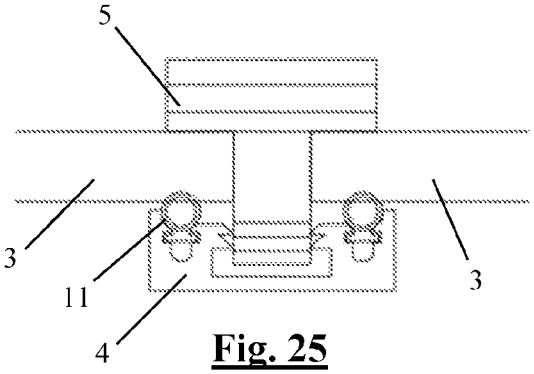
Figure 26:
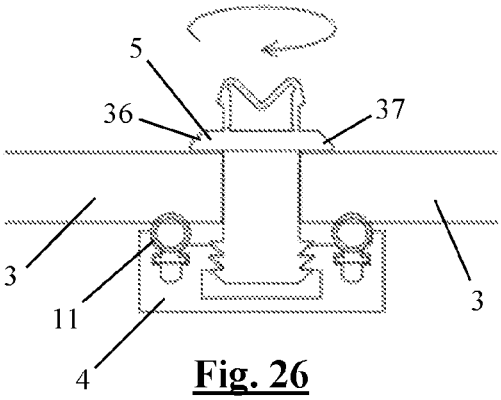

In order to fix a depicted securing element (5) to a support profile (4, 25, 26, 27), this securing element (5) is arranged in a first position with one end of the support profile fixing part (15) in the attachment groove (13) of the support profile (4, 25, 26, 27), as illustrated in FIGS. 9-10 and in FIGS. 24-25. In this first position, the engagement element (9) remains separate from the support profile (4, 25, 26, 27) so that the securing element (5) is movable transversely on the holding side (7) relative to the support profile (4, 25, 26, 27). With the engagement element (9) in the attachment groove (13), the securing element (5) is then twisted through 90° about the rotational axis (R) (see FIG. 11 and FIG. 26) into a second position, in which an engagement element (9) engages behind retention edges (8) of the support profile (4, 25, 26, 27) in order to fix the securing element (5) to the support profile (4, 25, 26, 27).

The depicted securing element (5) is rotationally symmetrical. When the securing element (5) is twisted through 180° relative to the rotational axis (R), this securing element (5) remains identical. In this way, said securing element (5) can easily be brought into the first position relative to a support profile (4, 25, 26, 27).

To allow the engagement edge (9) to engage easily in the attachment groove (13) behind the retention edges (8), at opposite corners said engagement edge (9) is provided with a taper (17) with a thinner point which gradually widens so that, on twisting of the securing element (5) from the first position to the second position, the engagement edge (9) is gradually clamped behind the retention edges (8).

At various points, the securing element (5) is provided with the necessary roundings (21) and chamfers (22) to allow twisting of the securing element (5).

Each engagement edge (9) is furthermore also provided with a limiting surface (20) to abut against the side walls (10) of the attachment groove (13) in order to limit the rotational movement of the securing element (5) on twisting of the securing element (5) from the first position to the second position.

Figure 14:
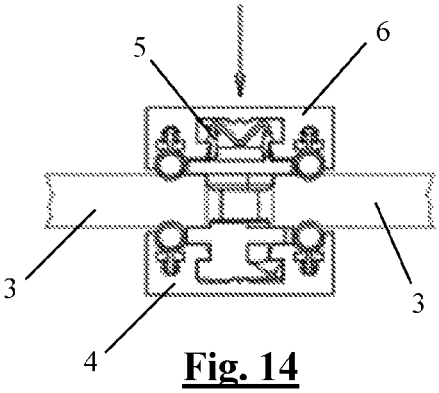
Figure 15:
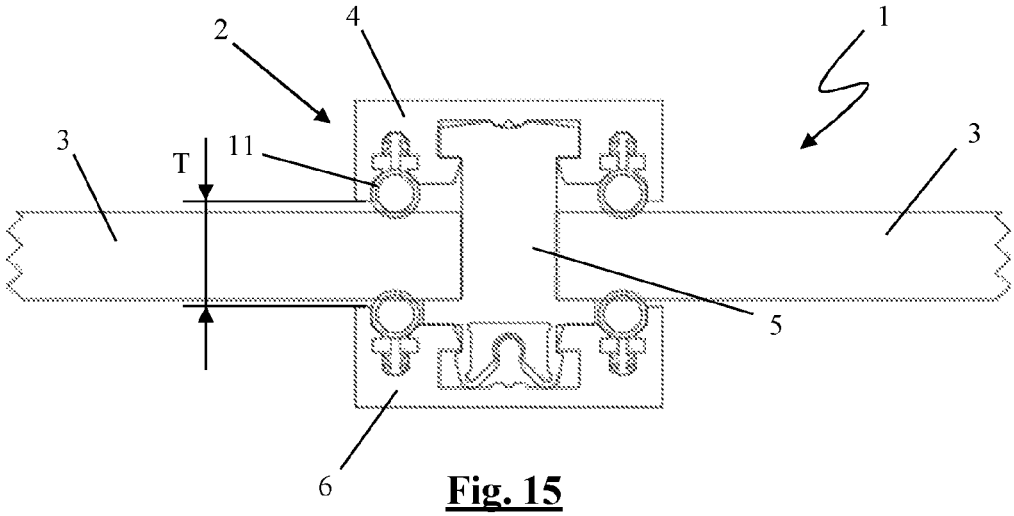
FIG. 15 shows in top view a part of a wall assembly according to the invention in mounted state at the level of the connection of two glass panels, a securing element from FIG. 1, a support profile from FIG. 3, and a closing profile from FIG. 3.
Figure 16:
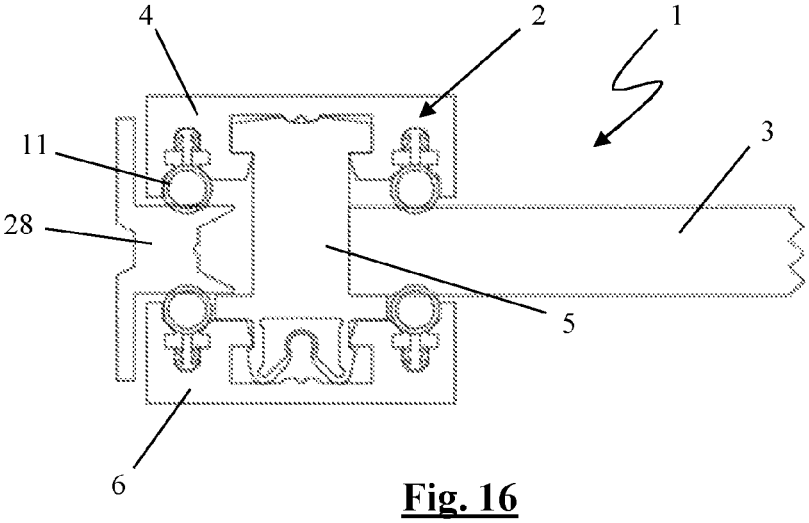
FIG. 16 shows in top view a part of a wall assembly according to the invention in mounted state at the level of the connection of a glass panel, a standard profile from FIG. 6, a securing element from FIG. 1, a support profile from FIG. 3, and a closing profile from FIG. 3.
Figure 17:
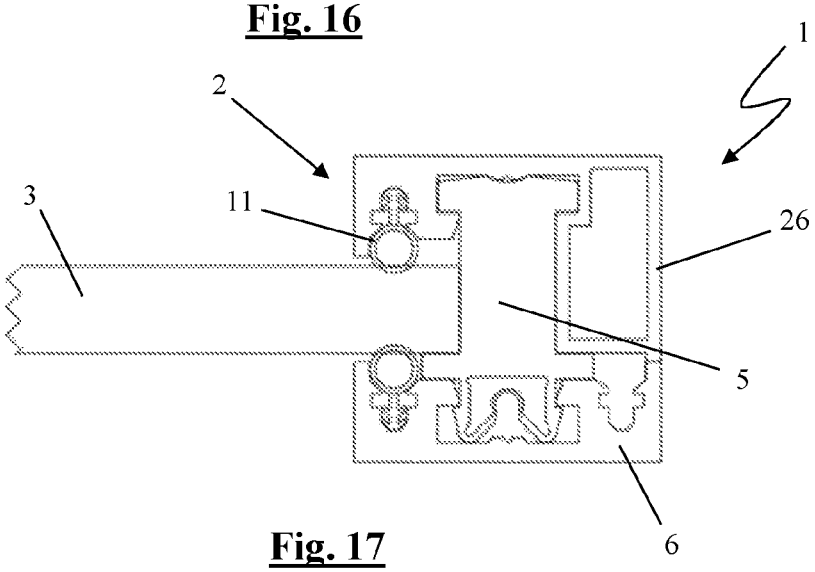
FIG. 17 shows in top view a part of a wall assembly according to the invention in mounted state at the level of the connection of a glass panel, a securing element from FIG. 1, an end profile from FIG. 4, and a closing profile from FIG. 3.
Figure 18:
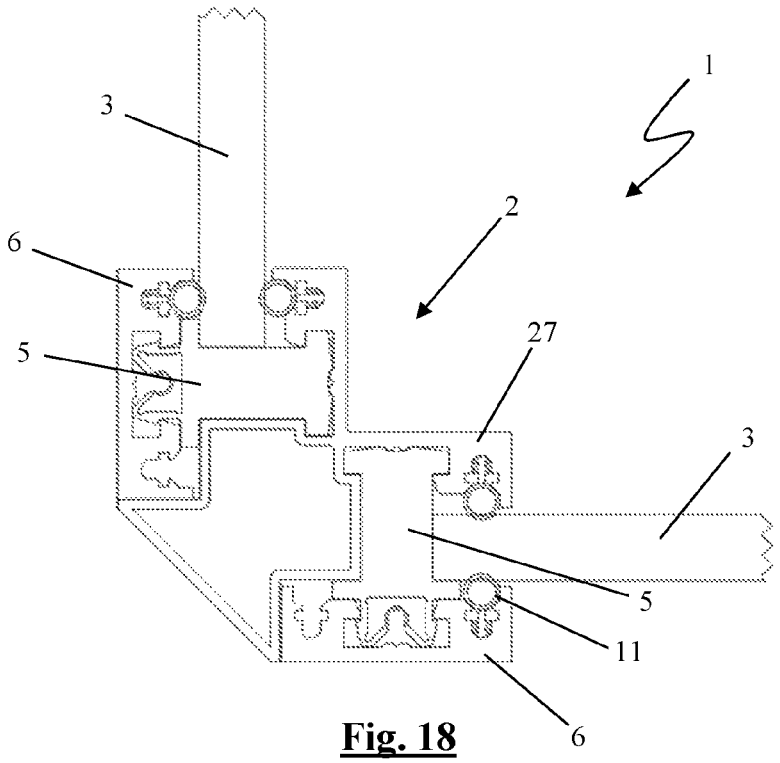
FIG. 18 shows in top view a part of a wall assembly according to the invention in mounted state at the level of the connection of two glass panels, two securing elements from FIG. 1, a corner profile from FIG. 8, and two closing profiles from FIG. 3.
Figure 19:
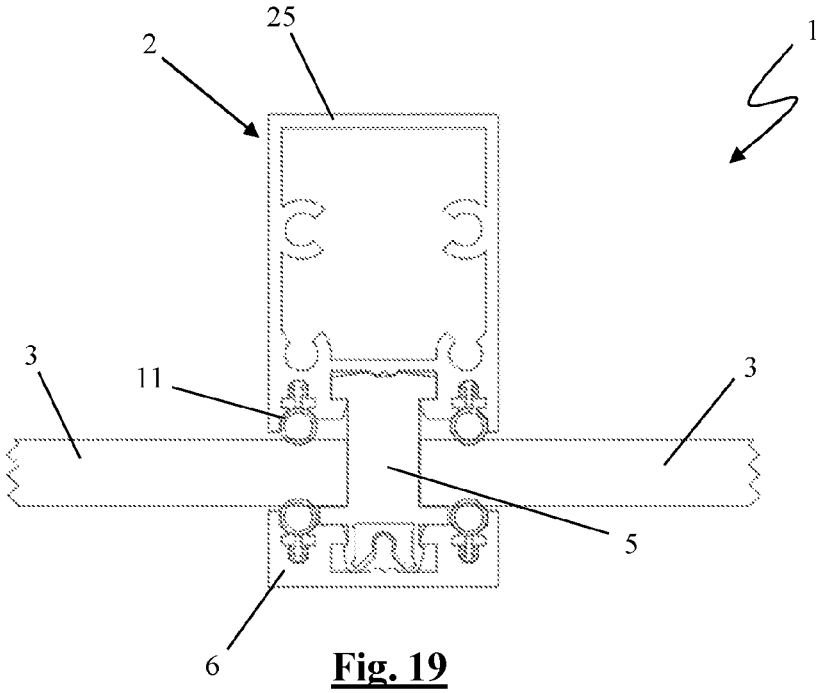
FIG. 19 shows in top view a part of a wall assembly according to the invention in mounted state at the level of the connection of two glass panels, a securing element from FIG. 1, a support profile from FIG. 5 and a closing profile from FIG. 3.
Figure 20:
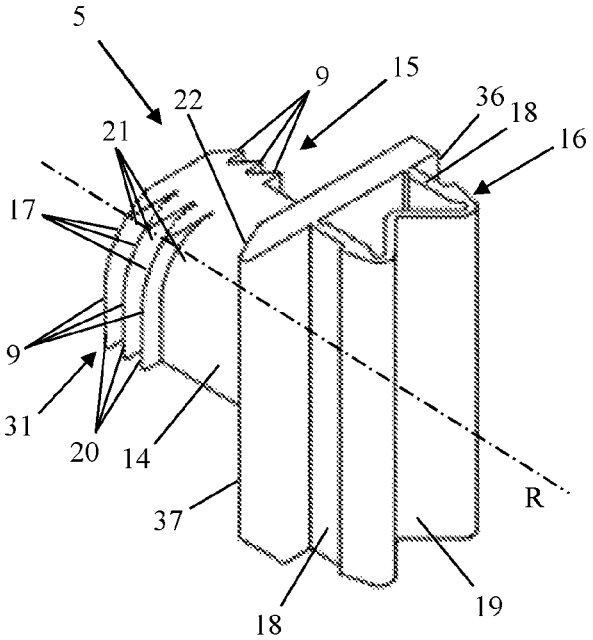
FIG. 20 shows in perspective a second embodiment of a securing element of a fixing device according to the invention, viewed from above, from the front, from the left side.
Figure 21:
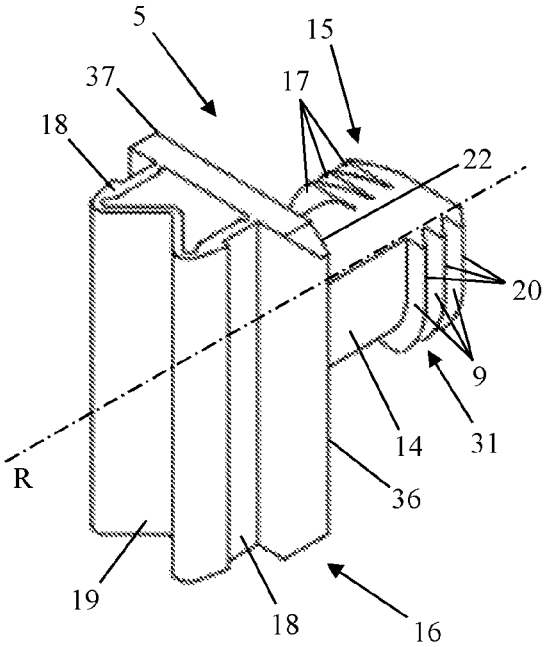
FIG. 21 shows in perspective the securing element from FIG. 20 viewed from above, from the front, from the right side.
Figure 22:
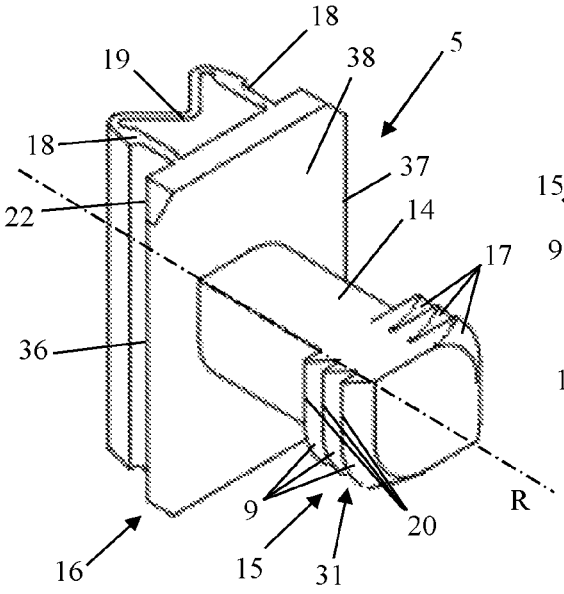
FIG. 22 shows in perspective the securing element from FIG. 20 viewed from above, from behind, from the left side.
Figure 23:
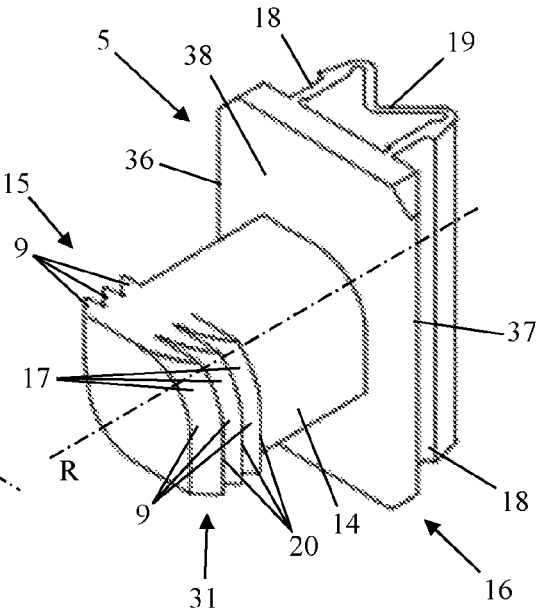
FIG. 23 shows in perspective the securing element from FIG. 20 viewed from above, from behind, from the right side.

The closing profile fixing part (16) of the securing element (5) is also provided with click legs (18) for click-fastening the securing element (5) behind the retention edges (8) of the closing profile (6), as shown in FIG. 14 and FIG. 27. These click legs (18) are in each case mutually connected by a central elastic connection (19).

When the closing profile (6) is click-fastened onto the securing element (5), the side walls (10) of the attachment groove (18) secure the click legs (18) so as to prevent the securing element (5) from twisting back from the second position to the first position.

To be able to erect walls with the wall assembly (1) shown, firstly in the known fashion standard profiles (28) are placed precisely at the desired positions. Using the support profiles (4, 25, 26, 27), frames can be assembled with the desired dimensions for placing the panels (3) thereon. At places where the walls are to be attached to the standard profiles (28), these frames may be provided with normal support profiles (4) or with thickened support profiles (25). At places where the walls are to be erected free-standing and hence not attached to a standard profile (28), these frames may be provided with an end profile (26). At places where walls are to be connected to one another at an angle, these frames may be provided with a corner profile (27).

Frames formed in this way may then be placed at the desired position against the standard profiles (28) and fixed thereto.

Panels (3) may then be placed against the support profiles (4, 25, 26, 27) and fixed to these support profiles (4, 25, 26, 27) by means of securing elements (5). For this, the securing elements (5) are each provided with a securing face (38) which protrudes relative to the core (14) and behind which the panels (3) engage when the securing elements (5) are fixed to the support profiles (4, 25, 26, 27) and for this brought into the second position. When two panels (3) are mounted on either side of the securing elements (5), a first panel (3) here engages behind a first securing edge (36) of each securing element (5) and a second panel (3) engages behind a second securing edge (37) of each securing element (5). When a single panel (3) is mounted with the securing elements (5), this panel (3) engages behind one of the two securing edges (36, 37). After fixing the securing elements (5) to the support profiles (4, 25, 26, 27), wherein the panels (3) are thus secured, closing profiles (6) may be click-fastened to the securing elements (5).

Edges where standard profiles (28) are situated may be finished with mastic.

To compensate for different thicknesses of walls (3), the core (14) of the first depicted embodiment of the securing element (5) is made of elastic legs (30). Instead of allowing the elements (30) of these legs to deform elastically relative to one another, they may for example alternatively also be attached by hinges. The complete core (14) may also be made of elastically compressible material. The support profile fixing part (15) and the closing profile fixing part may also be connected to one another by means of a spring.

Figure 12:
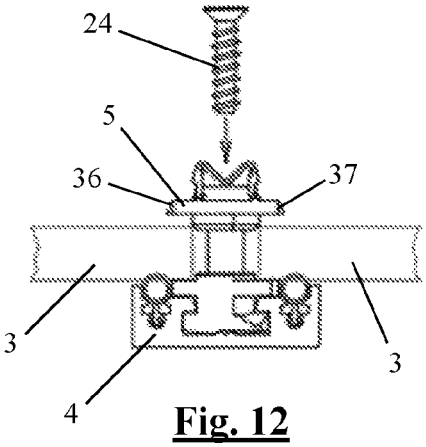
Figure 13:
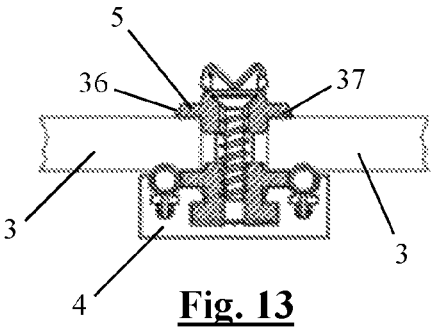

The securing element (5) is furthermore provided with a screw hole (23) in which a screw (24) may be inserted. As shown in FIGS. 12-13, by means of this screw (24), the support profile fixing part (15) and the closing profile fixing part (16) may be moved towards one another or away from one another in order thus to adjust the intermediate distance (T) between the support profile (4, 25, 26, 27) and the closing profile (6).

In the second depicted embodiment of the securing element (5), the securing element (5) is provided with a plurality of engagement edges (9) which are designed for stepped engagement behind retention edges (8) of the support profile (4). In FIG. 27, the retention edges (8) are evenly distributed between the engagement edges (9) of the securing element (5), which are arranged in a stepped pattern, so as to allow thicker panels (3) to be placed between the support profile (4) and the closing profile (6).

In order to be able to place even thicker panels (3) between the support profile (4) and the closing profile (6), it is possible to arrange the securing element (5) less deeply in the attachment groove (13) so that only one of the engagement edges (9) engages behind a retention edge (8) of the support profile (4).

In FIGS. 28 and 29, the securing element (5) is maximally inserted in the attachment groove (13) and, again, several engagement edges (9) of the securing element (5) engage behind corresponding retention edges (8) of the support profile (4) so that thinner panels (3) can be placed between the support profile (4) and the closing profile (6).

In FIG. 28, the panels (3) are slightly thicker than in FIG. 29. In FIG. 28, the seals (11) are for this compressed further than in FIG. 29.

In this way, the intermediate distance (T) between the support profile (4) and the closing profile (6) can be adapted by arranging the securing element (5) to varying depths in the attachment groove (13), with more or fewer engagement edges (9) engaging behind corresponding retention edges (8), and by compressing the seals (11) to a greater or lesser extent.

In the third depicted embodiment of the securing element (5), the core (14) comprises a first core part (33) and a second core part (34). The first core part (33) is here provided on the closing profile fixing part (16), and the second core part (34) is provided on the support profile fixing part (15). Alternatively, the first core part (33) may also be provided on the support profile fixing part (15), and the second core part (34) on the closing profile fixing part (16). The first core part (33) is provided with a click-in element (33) with several click edges (35), and a second core part (34) is provided with a corresponding click edge (32) for a said click edge (35) to engage behind for implementing a click connection to form the core (14).

By click-fastening more or fewer click edges (35) of the click-in element (31) of the first core part (33) behind the click edge (32) of the second core part (34), the intermediate distance (T) between the support profile (4) and the closing profile (6) can be adjusted.

To attach the first core part (33) and the second core part (34) together more rigidly, in addition a screw (24) may be inserted in a screw hole (23) provided for this purpose in both core parts (33, 34).

The invention claimed is:

1. Fixing device for mounting wall elements for constructing a wall, the fixing device comprising:

a support profile having a holding side for fixing the wall elements thereto;

a securing element which is provided with an engagement element for engaging on the support profile for fixing the securing element to the support profile, and which is designed to extend between the wall elements; and a closing profile which is attachable to the securing element for holding the wall elements between the support profile and the closing profile;

wherein for fixing to the support profile, the securing element is configured to turn, relative to the support profile, between a first position and a second position, wherein the turning alone results in movement of the securing element between the first position and the second position, wherein:

in the first position, the engagement element remains separate from the support profile so that the securing element is movable transversely on the holding side relative to the support profile, and in the second position, the engagement element engages on the support profile so as to fix the securing element to the support profile, and in which the closing profile is fixable to the securing element; and in the second position, the securing element alone directly secures the wall elements, and the closing profile includes a blocking element in order, on fixing of the closing profile to the securing element, to prevent the securing element from twisting back from the second position to the first position, wherein the securing element is configured to be turned in its entirety between the first position and the second position.

2. Fixing device according to claim 1, wherein:

for securing the wall elements, the securing element includes a first securing edge for a first said wall element to engage behind in the second position, and a second securing edge for a said second wall element to engage behind in the second position.

3. Fixing device according to claim 2, wherein:

the securing element includes a support profile fixing part which is provided with said engagement element for fixing to the support profile, and includes a closing profile fixing part which is provided for fixing to the closing profile, and includes a core which connects together the support profile fixing part and the closing profile fixing part; and the first securing edge and the second securing edge form part of the closing profile fixing part.

4. Fixing device according to claim 3, wherein:

when the securing element is fixed to the support profile and when the closing profile is fixed to the securing element, the closing profile is set at an intermediate distance from the support profile and the fixing device includes adjustment means for setting this intermediate distance; and the core is designed so as to be flexible, and the adjustment means are designed to move the support profile fixing part and the closing profile fixing part relative to one another by means of deformation of the core.

5. Fixing device according to claim 1, wherein:

the closing profile is fixable to the securing element by means of a click connection.

6. Fixing device according to claim 5, wherein:

the closing profile is provided with an attachment groove which is delimited on either side by an undercut retention edge and that the securing element is provided with two click legs corresponding to the retention edges of the closing profile for click-fastening the securing element behind the retention edges of the closing profile in order to implement the click connection.

7. Fixing device according to claim 6, wherein:

the attachment groove of the closing profile is provided with upright side edges which each serve as a said blocking element.

8. Fixing device according to claim 1, wherein:

the securing element includes a support profile fixing part which is provided with said engagement element for fixing to the support profile, and includes a closing profile fixing part which is provided for fixing to the closing profile, and includes a core which connects together the support profile fixing part and the closing profile fixing part.

9. Fixing device according to claim 8, wherein:

the adjustment means includes a click-in element with several click edges designed for stepped implementation of the click connection; and the core includes a first core part which is provided with the said click-in element, and includes a second core part which is provided with an engagement edge for a said click edge of the click-in element to engage behind in order to implement the click connection to form the core.

10. Fixing device according to claim 1, wherein:

when the securing element is fixed to the support profile and when the closing profile is fixed to the securing element, the closing profile is set at an intermediate distance from the support profile, and the fixing device includes adjustment means for setting this intermediate distance.

11. Fixing device according to claim 10, wherein:

the securing element is provided with several said engagement elements which form part of the adjustment means and are designed for stepped engagement on the support profile for fixing the securing element to the support profile.

12. Fixing device according to claim 11, wherein:

the adjustment means includes a click-in element with several click edges designed for stepped implementation of the click connection; and the engagement elements of the securing element together form said click-in element.

13. Fixing device according to claim 10, wherein:

the adjustment means includes a click-in element with several click edges, designed for stepped implementation of the click connection.

14. Fixing device according to claim 1, wherein:

the support profile and the closing profile are identical to one another.

15. Wall assembly, the wall assembly comprising:

two wall elements and a fixing device for mounting said wall elements, and the fixing device is a fixing device according to claim 1.

16. Fixing device according to claim 1, wherein:

for securing the wall elements, the securing element includes a first securing edge for a first said wall element to engage behind in the second position, and a second securing edge for a said second wall element to engage behind in the second position;

the securing element includes a support profile fixing part which is provided with said engagement element for fixing to the support profile, and includes a closing profile fixing part which is provided for fixing to the closing profile, and includes a core which connects together the support profile fixing part and the closing profile fixing part;

the first securing edge and the second securing edge form part of the closing profile fixing part; and when the securing element is fixed to the support profile and when the closing profile is fixed to the securing element, the closing profile is set at an intermediate distance from the support profile, and the fixing device includes adjustment means for setting this intermediate distance.

17. Fixing device according to claim 1, wherein the support profile is provided with an attachment groove and wherein, in the first position, the engagement element physically contacts the attachment groove.

* * * * *